US008047043B2

(12) United States Patent
Kuo et al.

(10) Patent No.: US 8,047,043 B2
(45) Date of Patent: Nov. 1, 2011

(54) PUNCH DIE AND PUNCH MACHINE USING THE SAME

(75) Inventors: Pei-Chin Kuo, Taipei Hsien (TW); Juey-Fong Chang, Taipei Hsien (TW); Wen-Tao Wang, Shenzhen (CN); Zhi-Gang Hu, Shenzhen (CN); Cheng-Hung Lin, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 479 days.

(21) Appl. No.: 12/211,054

(22) Filed: Sep. 15, 2008

(65) Prior Publication Data

US 2009/0229336 A1 Sep. 17, 2009

(30) Foreign Application Priority Data

Mar. 11, 2008 (CN) ..... 2008 1 0300525

(51) Int. Cl.
*B21D 22/00* (2006.01)
*B21J 5/00* (2006.01)

(52) U.S. Cl. ..... 72/353.2; 72/354.2

(58) Field of Classification Search ..... 72/332, 72/352, 353.2, 355.2, 355.4, 355.6, 354.2, 72/354.6, 354.8, 358, 359
See application file for complete search history.

(56) References Cited

U.S. PATENT DOCUMENTS 4,841,622 A * 6/1989 Murano et al. ..... 72/355.4
4,905,556 A * 3/1990 Haack et al. ..... 72/335
6,178,801 B1 * 1/2001 Ishida ..... 72/354.2

FOREIGN PATENT DOCUMENTS

JP 03297532 A * 12/1991

* cited by examiner

*Primary Examiner* — Teresa Ekiert
(74) *Attorney, Agent, or Firm* — Altis Law Group, Inc.

(57) ABSTRACT

An exemplary punch die (30) includes a lower die (40) and an upper die (50). The lower die includes a die core (45), a blank holder (417), and a cylinder (413) disposed in the lower die. The blank holder is disposed on a periphery of the die core. The cylinder is connected to the blank holder and provides a constant force to the blank holder. The upper die includes a punch core corresponding to the die core. A punch machine using the present punch die is also provided.

11 Claims, 3 Drawing Sheets

PUNCH DIE AND PUNCH MACHINE USING THE SAME

BACKGROUND OF THE INVENTION

1. Field of the Invention

The present invention relates to punch dies and, more particularly, to a punch die for a punch machine.

2. Discussion of the Related Art

Referring to FIG. 3, a related-art punch die 10 includes an upper die 12 and a lower die 14. The punch die 10 is generally installed on a punch machine 20, and configured to punch a metallic workpiece. The punch machine 20 includes a base set 22, and a bracket 24 supported by the base set 22. The upper die 12 is attached to the bracket 24, and can be moved downwards by a first cylinder 242. The lower die 14 is disposed on the base set 22. A blank holder 16 is sleeved on the base set 22. A second cylinder 222 is disposed in the base set 22. The second cylinder 222 is connected to the blank holder 16 for providing a constant force to the blank holder 16.

The second cylinder 222 is disposed in the base set 22. When the second cylinder 222 breaks down, the punch machine 20 should be hoisted up so that the second cylinder 222 can be taken out of the base set 22 for repairing. As such, it is very cumbersome to repair the second cylinder 222. Thus, the blank holder 16 is generally replaced by a spring or an air cushion that is easily disassembled. When a metallic workpiece is punched, the spring or the air cushion applies a force to the metallic workpiece. The force is related to a force provided by the second cylinder 222 and the compression of the spring or the air cushion. Since the compression of the spring or the air cushion is often inconstant, the force applying to the metallic workpiece is unstable, which leads the punched workpiece to have an unstable size.

Therefore, a punch die and a punch machine using the same which is easily repaired and can punch a workpiece with a stable size.

SUMMARY

In one aspect, a punch die includes a lower die and an upper die. The lower die includes a die core, a blank holder, and a cylinder disposed in the lower die. The blank holder is disposed on a periphery of the die core. The cylinder is connected to the blank holder and provides a constant force to the blank holder. The upper die includes a punch core corresponding to the die core.

In another aspect, a punch machine includes a base set, a bracket disposed on the base set, a driving device disposed on the bracket, and a punch die. The punch die includes a lower die and an upper die. The lower die includes a die core, a pressing member, and a cylinder disposed in the lower die. The pressing member is disposed on a periphery of the die core. The cylinder is connected to the pressing member and provides a constant force to the pressing member. The upper die includes a punch core corresponding to the die core. One of the lower die and the upper die is placed on the base set of the punch machine, the other is fixed to the bracket, and driven by the driving device.

Other advantages and novel features will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of the present a punch die and a punch machine using the same. Moreover, in the drawings, like reference numerals designate corresponding parts throughout the several views.

DETAILED DESCRIPTION OF THE EMBODIMENTS

Figure 1:
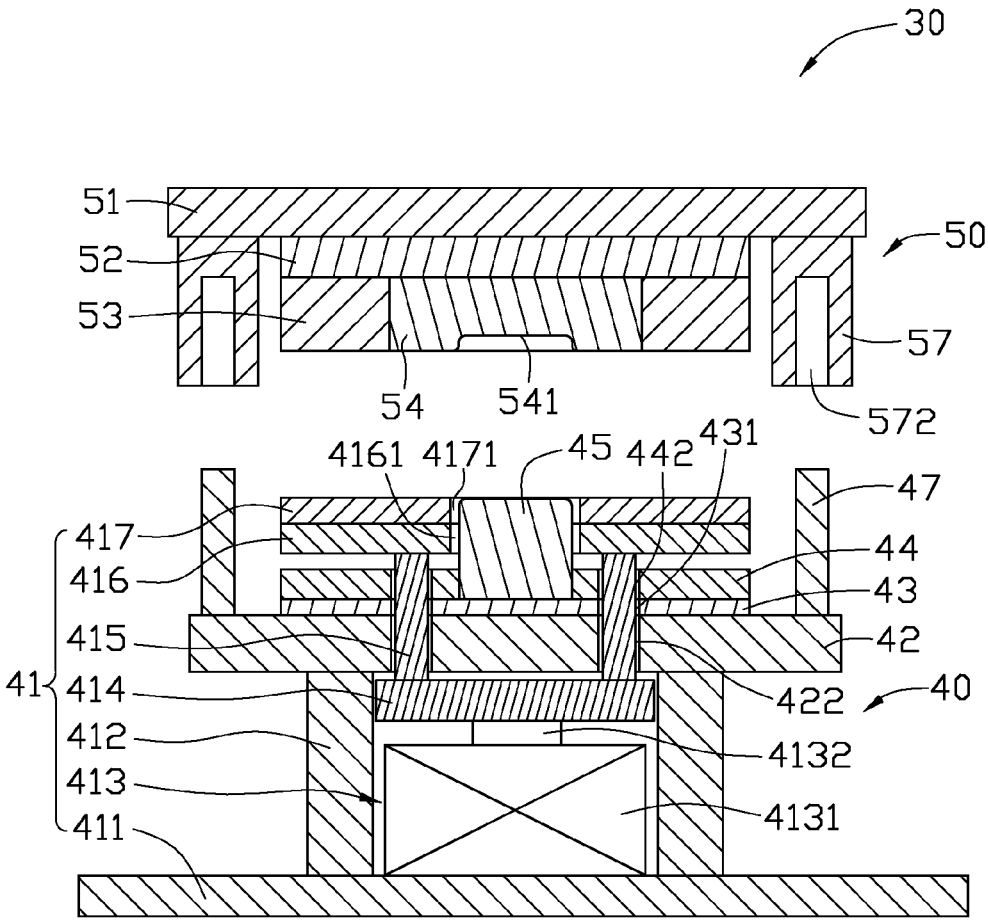
FIG. 1 is a cross-sectional, schematic view of a punch die in accordance with an exemplary embodiment.

Referring to FIG. 1, a punch die 30 used to punch a workpiece is shown. The punch die 30 includes a lower die 40 and an upper die 50. The lower die 40 includes a pressing assembly 41, a die set 42, a lower padding plate 43, a die holder 44, a die core 45, and a plurality of fixing members (not shown).

The pressing assembly 41 includes a supporting plate 411, a sleeve 412, a cylinder 413, a top plate 414, two top rods 415, a baffle plate 416, and a blank holder 417. The sleeve 412 is fixed to the supporting plate 411. The cylinder 413 is disposed in the sleeve 412, and fixed to the supporting plate 411. The cylinder 413 is a thin type cylinder, and includes a main body 4131 and a piston rod 4132. The main body 4131 is configured to provide an adjustable and constant force to the piston rod 4132. The top plate 414 is received in the sleeve 412, and is fixed to the piston rod 4132.

The die set 42 defines two through holes 422 for the top rods 415 to extend through. A plurality of guiding posts 47 are fixed to a top surface of the die set 42.

The lower padding plate 43, the die holder 44, the baffle plate 416, and the blank holder 417 are substantially rectangular, and are disposed on the die set 42 in that order. The lower padding plate 43 defines a pair of assembly holes 431 for the top rods 415 to extend through correspondingly. The die holder 44 defines a fixing hole (not labeled) for the die core 45 to extend through, and two assembly holes 442 for the top rods 415 to extend through correspondingly. The lower padding plate 43 and the die holder 44 are fixed to the die set 42 via the fixing members.

The baffle plate 416 defines a through hole 4161 in a middle portion. The blank holder 417 defines a through hole 4171 in a middle portion. The through holes 4161, 4171 are configured for the die core 45 to extend through. The baffle plate 416 is fixed to the blank holder 417 via the fixing members. One end of each top rod 415 is attached to a surface of the top plate 414. The other end of each top rod 415 is passed through the die set 42, the lower padding plate 43, the die holder 44, and then fixed to the baffle plate 416. The die core 45 is disposed in the fixing hole of the die holder 44, and fixed to the lower padding plate 43 via the fixing members. The baffle plate 416 and the blank holder 417 are sleeved on the die core 45. The cylinder 413 drives the baffle plate 416 and the blank holder 417 to move relative to the die core 45.

The upper die 50 includes a punch set 51, an upper padding plate 52, a punch plate 53, a punch core 54, and a plurality of the fixing members (not shown). The punch set 51 is substantially rectangular. A plurality of outer bushes 57 are fixed to a surface of the punch set 51. Each outer bush 57 defines a dowel hole 572 for engaging with one of the guiding posts 47.

The upper padding plate 52 is fixed to a surface of the punch set 51 via the fixing members, and the punch plate 53 is fixed to the upper padding plate 52 via the fixing members. The punch plate 53 defines a holding hole (not labeled). The punch core 54 is received in the holding hole, and is fixed to the upper padding plate 52. The punch core 54 corresponds to the die core 45, and defines a cavity 541 for engaging with the die core 45. The width of the cavity 541 is lager than that of the die core 45.

Figure 2:
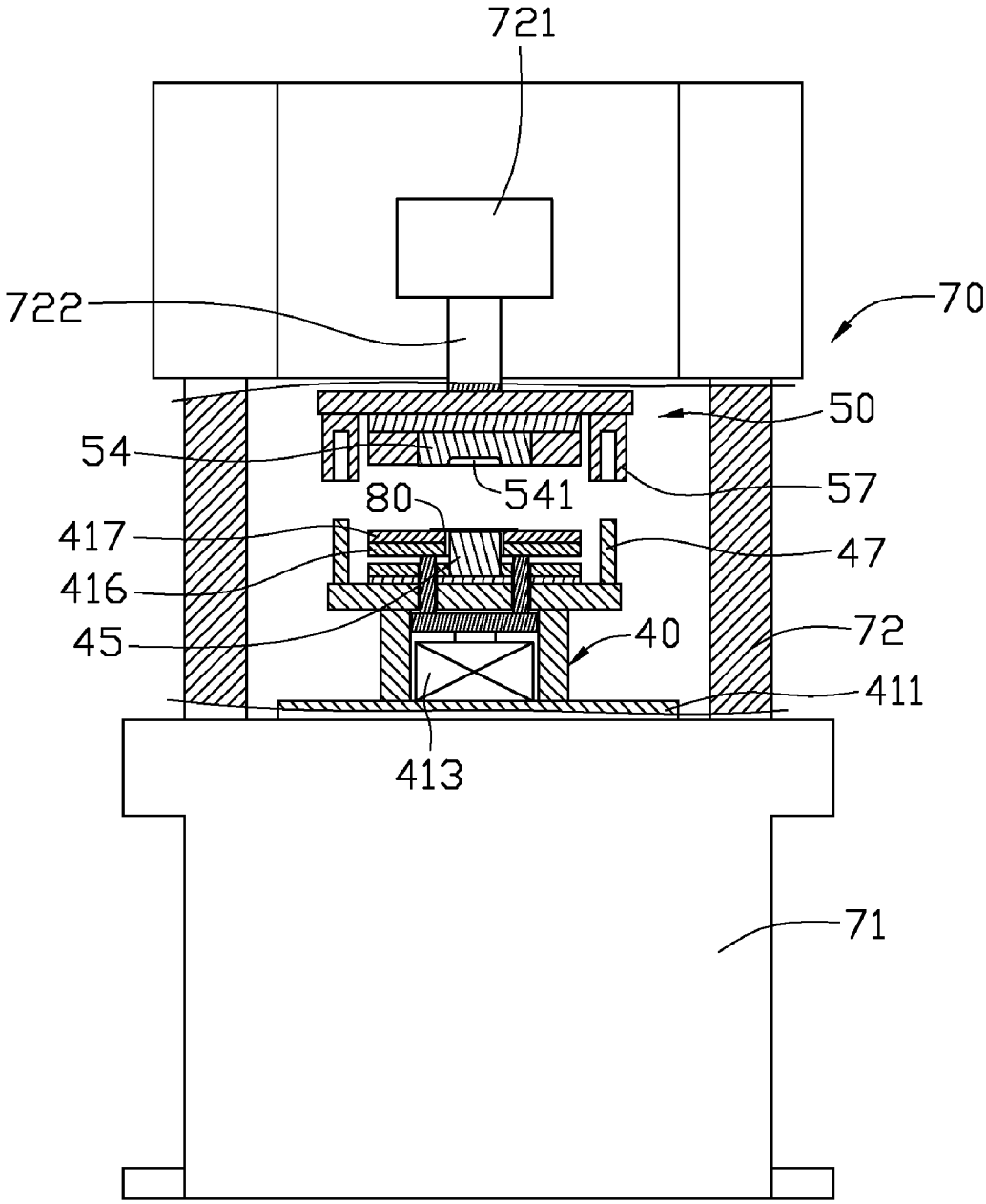
FIG. 2 is a schematic view of a punch machine with a cross-sectional view of the punch die in FIG. 1.
Figure 3:
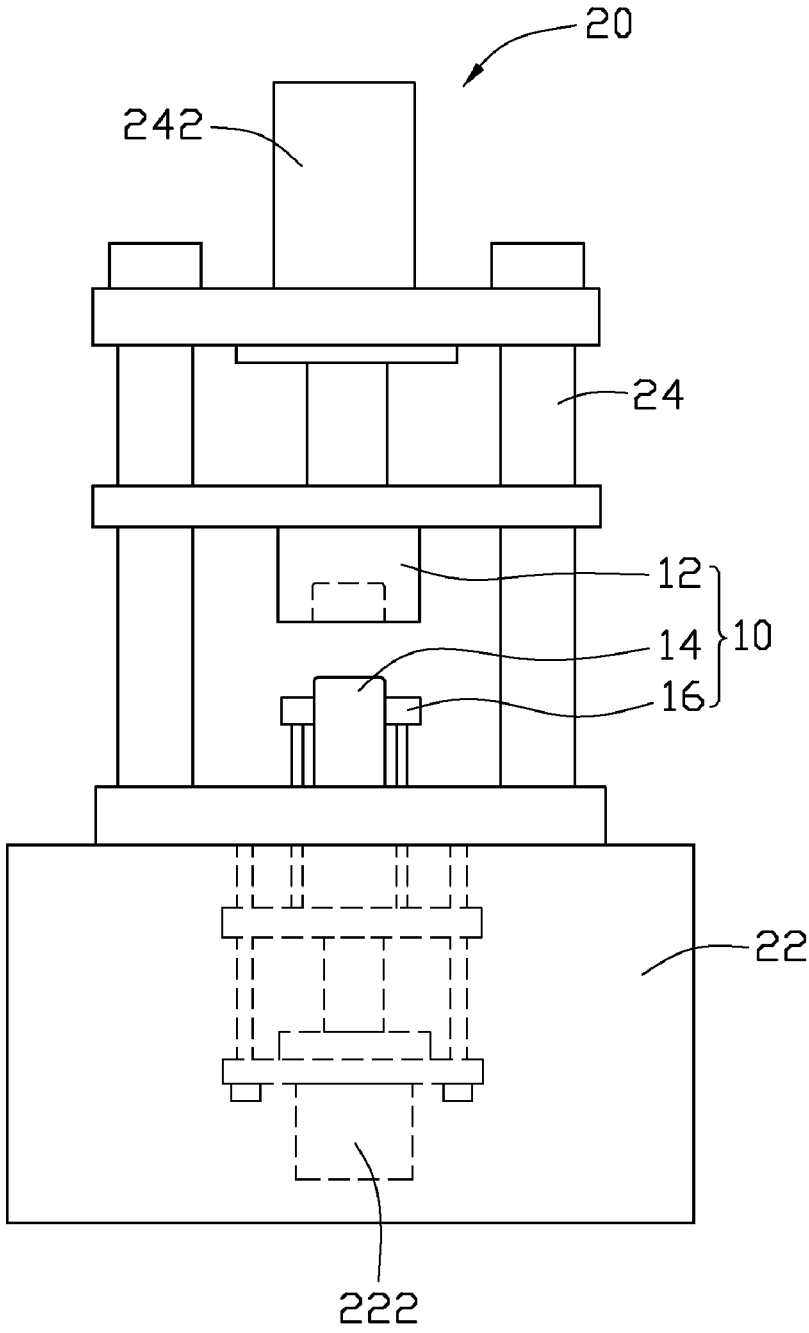
FIG. 3 (RELATED ART)
FIG. 3 is a schematic view of a related-art punch die.

Referring also to FIG. 2, a punch machine 70 includes a base set 71, a bracket 72, and the punch die 30. A driving device 721 and a guiding rod 722 connected to the driving device 721 are disposed on the bracket 72. The supporting plate 411 of the lower die 40 is placed on and fixed to the base set 71. The punch set 51 of the upper die 50 is fixed to the guiding rod 722.

When a metallic workpiece 80 is punched, the top surface of the blank holder 417 and the top surface of the die core 45 are adjusted to a same plane. The metallic workpiece 80 is placed on the die core 45. The upper die 50 is driven by the driving device 721 and moves downwards. When the driving device 721 moves downwards, the dowel holes 572 sleeves onto the guiding posts 47, and, as a result, the upper die 50 moves downwards, the guiding posts 47 protrudes into the dowel holes 572 of the outer bushes 57. When the punch plate 53 of the upper die 50 contacts the metallic workpiece 80, the cylinder 413 actuated, thereby creating a constant force that pushes the piston rod 4132 upwards. The constant force pushes the blank holder 417 upwards via the top plate 414, the top rods 415, and the baffle plate 416. Thus, the workpiece 80 becomes clamped between the blank holder 417 and the punch core 54. After that, the upper die 50 moves downwards further, and pushes the blank holder 417 and the baffle plate 416 to move downwards. The workpiece 80 is partially pressed into the cavity 541 of the punch core 54 until the workpiece 80 is stamped into a predetermined shape.

In alternative embodiments, there may be more than two top rods 415 connected to the blank holder 417. The number of the die cores 45 may be two or more than two. In such cases, the number of the punch core 54 of the upper die 50 corresponds to the number of the die core 45. A blank holder 417 is sleeved on each die core 45. Each blank holder 417 is driven by a corresponding cylinder 413. Alternatively, the lower die 40 of the punch die 30 may be fixed to the guiding rod 722. In such condition, the upper die 50 is placed on and fixed to the base set 71. The blank holder 417 may be other pressing members, such as a pressing washer.

It should be understood that, since the cylinder 413 is disposed in the punch die 30, when the cylinder 413 breaks down, the cylinder 413 is easily taken out for repairing. The cylinder 413 provides a constant force to the blank holder 417. Thus, the blank holder 417 applies the constant force to the metallic workpiece 80, which leads the punched workpiece to have a stable size.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A punch die, comprising:

a lower die including a die set, a die core fixed to the die set, a pressing member, and a cylinder disposed in the lower die and positioned under the die set, the die set comprising a plurality of guiding posts fixed to a top surface thereof, the pressing member being disposed on a periphery of the die core, the cylinder being connected to the pressing member for providing a force to the pressing member; and an upper die including a punch set, a punch core corresponding to the die core; the punch set comprising a plurality of outer bushes fixed to a surface thereof, each outer bush defining a dowel hole for engaging with one of the guiding posts;

wherein the lower die further comprises a lower padding plate, and a die holder, the lower padding plate is fixed to the die set, and the die holder is fixed to the lower padding plate, the die holder defines a fixing hole, the die core is received in the fixing hole of the die holder, and fixed to the lower padding plate.

2. The punch die as claimed in claim 1, wherein the upper die further comprises an upper padding plate, and a punch plate, the upper padding plate is fixed to the punch set, a punch plate is fixed to the upper padding plate, the punch plate defines a holding hole, the punch core is received in the holding hole and fixed to the upper padding plate.

3. The punch die as claimed in claim 1, wherein the lower die further comprises a supporting plate and a sleeve, the supporting plate and the die set are disposed on opposite sides of the sleeve, and the cylinder is received in the sleeve and fixed on the supporting plate.

4. The punch die as claimed in claim 3, wherein the pressing member is sleeved on the die core, the cylinder includes a main body and a piston rod, the lower die further includes a top plate and a plurality of top rods, the top plate is fixed to the piston rod, the top rods are fixed to the top plate, the top rods are passed through the die set, the lower padding plate, and the die holder in that order, and then connected to the pressing member.

5. The punch die as claimed in claim 4, wherein the lower die further comprises a baffle plate, the baffle plate is sleeved on the die core and fixed to the top rods, the pressing member is fixed to a surface of the baffle plate adjacent to the upper die.

6. A punch machine, comprising:

a base set;

a bracket disposed on the base set;

a driving device disposed on the bracket; and a punch die, the punch die including:

a lower die including a die set, a die core fixed to the die set, a pressing member, and a cylinder disposed in the lower die and positioned under the die set, the die set comprising a plurality of guiding posts fixed to a top surface thereof, the pressing member being disposed on a periphery of the die core, the cylinder being connected to the pressing member for providing a constant force to the pressing member; and an upper die including a punch set, a punch core corresponding to the die core; the punch set comprising a plurality of outer bushes fixed to a surface thereof, each outer bush defining a dowel hole for engaging with one of the guiding posts, one of the lower die or the upper die being placed on the base set of the punch machine, the other being fixed to the bracket, and driven by the driving device;

wherein the lower die further comprises a lower padding plate, and a die holder, the lower padding plate is fixed to the die set, and the die holder is fixed to the lower padding plate, the die holder defines a fixing hole, the die core is received in the fixing hole of the die holder, and fixed to the lower padding plate.

7. The punch machine as claimed in claim 6, wherein the lower die further comprises a supporting plate and a sleeve, the supporting plate and the die set are disposed on opposite sides of the sleeve, and the cylinder is received in the sleeve and fixed on the supporting plate.

8. The punch machine as claimed in claim 7, wherein the pressing member is sleeved on the die core, the cylinder includes a main body and a piston rod, the lower die further includes a top plate and a plurality of top rods, the top plate is fixed to the piston rod, the top rods are fixed to the top plate, the top rods are passed through the die set, the lower padding plate, and the die holder in that order, and then connected to the pressing member.

9. The punch machine as claimed in claim 8, wherein the lower die further comprises a baffle plate, the baffle plate is sleeved on the die core and fixed to the top rods, the pressing member is fixed to a surface of the baffle plate adjacent to the upper die.

10. The punch machine as claimed in claim 6, wherein the upper die further comprises an upper padding plate, and a punch plate, the upper padding plate and a punch plate are fixed to the punch set in that order, the punch plate defines a holding hole, the punch core is received in the holding hole and fixed to the upper padding plate.

11. The punch machine as claimed in claim 6, wherein the punch machine further includes a guiding rod connected to the driving device, the driving device and the guiding rod are disposed on the bracket, the lower die includes a supporting plate, the supporting plate is fixed to the base set of the punch machine, the upper die includes a punch set, and the punch set is connected to the guiding rod.

* * * * *